US005406927A

United States Patent [19]

Kato et al.

[11] Patent Number: 5,406,927

[45] Date of Patent: Apr. 18, 1995

[54] AIR-FUEL RATIO CONTROL APPARATUS FOR INTERNAL COMBUSTION ENGINE

[75] Inventors: Tatsunori Kato, Nagoya; Katsuhiko Kodama; Koji Okawa, both of Toyota; Mitsuru Takada, Aichi, all of Japan

[73] Assignees: Toyoda Jidosha Kabushiki Kaisha, Kariya; Nippondenso Co., Ltd., Toyota, both of Japan

[21] Appl. No.: 79,807

[22] Filed: Jun. 22, 1993

[30] Foreign Application Priority Data

Jun. 23, 1992 [JP] Japan ..... 4-164888

[51] Int. Cl.[6] ..... F02D 41/14

[52] U.S. Cl. ..... 123/674; 123/698

[58] Field of Search ..... 123/520, 674, 675, 698

[56] References Cited

U.S. PATENT DOCUMENTS

| | | | |
|---|---|---|---|
| 3,913,545 | 10/1975 | Haase et al. | 123/520 |
| 4,130,095 | 12/1978 | Bowler et al. | 123/675 |
| 4,467,769 | 8/1984 | Matsumura | 123/520 |
| 4,664,087 | 5/1987 | Hamburg | 123/520 |
| 4,748,959 | 6/1988 | Cook et al. | 123/520 |
| 4,951,637 | 8/1990 | Cook | 123/520 |
| 4,977,881 | 12/1990 | Abe et al. | 123/480 |
| 4,995,369 | 2/1991 | Cook | 123/520 |
| 5,027,780 | 7/1991 | Uranishi et al. | 123/520 |
| 5,048,492 | 9/1991 | Davenport et al. | 123/520 X |
| 5,048,493 | 9/1991 | Orzel et al. | 123/674 |
| 5,224,462 | 7/1993 | Orzel | 123/696 |
| 5,226,398 | 7/1993 | Cook et al. | 123/520 |
| 5,228,421 | 7/1993 | Orzel | 123/520 X |
| 5,245,978 | 9/1993 | Orzel | 123/696 X |
| 5,263,460 | 11/1993 | Baxter et al. | 123/520 |
| 5,299,546 | 4/1994 | Kato et al. | 123/520 |

FOREIGN PATENT DOCUMENTS

| | | |
|---|---|---|
| 63-129159 | 6/1988 | Japan . |
| 2-130240 | 5/1990 | Japan . |

*Primary Examiner*—Tony M. Argenbright
*Attorney, Agent, or Firm*—Cushman, Darby & Cushman

[57] ABSTRACT

An air-fuel ratio control apparatus constructed, in an engine of a type storing evaporated fuel generated in a fuel tank in a canister and thereafter drawing off the evaporated fuel to an intake side of an engine through a bleedoff passage, so as to inhibit renewal of an air-fuel ratio learning value when the evaporated fuel concentration is at a predetermined value or higher in case of learning and renewal of an air-fuel ratio in order to make feedback control of the air-fuel ratio of an air-fuel mixture supplied to the engine. In an apparatus which adsorbs evaporated fuel generated in a fuel tank in a canister and purges the evaporated fuel adsorbed in the canister to an intake side of an internal combustion engine together with air through a purge valve, an air-fuel ratio learning value is renewed in accordance with a deviation between an air-fuel ratio feedback FAF value detected by an oxygen sensor and a FAFSM value obtained by smoothing the FAF value with a large smoothing constant. Further, renewal of the air-fuel ratio learning value is inhibited when the concentration of the evaporated fuel is high, and renewal of the air-fuel ratio learning value is executed even during purge execution by the purge valve when the concentration is low.

9 Claims, 12 Drawing Sheets

| NE \ PM | 291 | 369 | 447 | 525 | 603 | 651 | 759 |
|---|---|---|---|---|---|---|---|
| 800 | 20.1 | 14.5 | 11.2 | 8.6 | 6.2 | 4.6 | 0.0 |
| 1200 | 12.5 | 9.3 | 7.2 | 5.5 | 4.0 | 2.9 | 0.0 |
| 1600 | 9.3 | 6.8 | 5.3 | 4.0 | 2.9 | 2.1 | 0.0 |
| 2000 | 7.9 | 5.7 | 4.4 | 3.3 | 2.4 | 1.8 | 0.0 |
| 2400 | 6.0 | 4.5 | 3.5 | 2.6 | 1.9 | 1.4 | 0.0 |
| 2800 | 5.5 | 4.1 | 3.1 | 2.3 | 1.7 | 1.2 | 0.0 |
| 3200 | 4.9 | 3.6 | 2.7 | 2.0 | 1.5 | 1.1 | 0.0 |
| 3600 | 4.1 | 3.0 | 2.2 | 1.7 | 1.3 | 0.9 | 0.0 |
| 4000 | 3.4 | 2.4 | 1.8 | 1.4 | 1.1 | 0.8 | 0.0 |

(mmHg)

(rpm)

LARGE
0
FIG. 13(a) PGR
HIGH
EVAPORATIVE CONCENTRATION

SLIPPAGE DUE TO INFLUENCE (BY EVAPORATED GAS
(FAFSM-FAFAV)
REFERENCE 1.0
FAF
FAFSM
1.0
0.9
0.8
FIG. 13(c) FAF
SMOOTHING CONSTANT FOR FAFSM
SMALL (1/128 SMOOTHING)
LARGE (1/256 SMOOTHING)

OPERATING AREA
A
B
A
B
A
B
TIME

FIG. 14
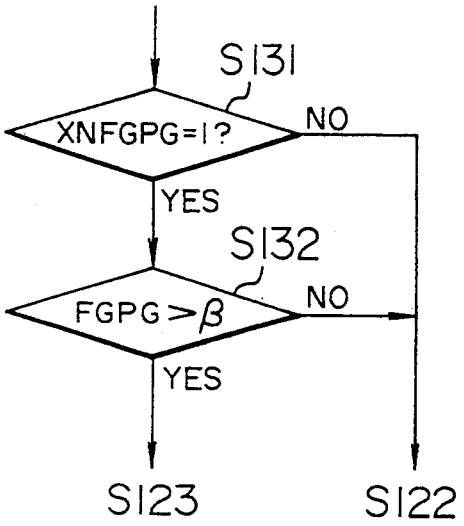
FIG. 15
(a) PARGE RATE (PGR)
FIG. 15
(b) FGPG
FIG. 15
(c) FPG
FIG. 15
(d) FAF
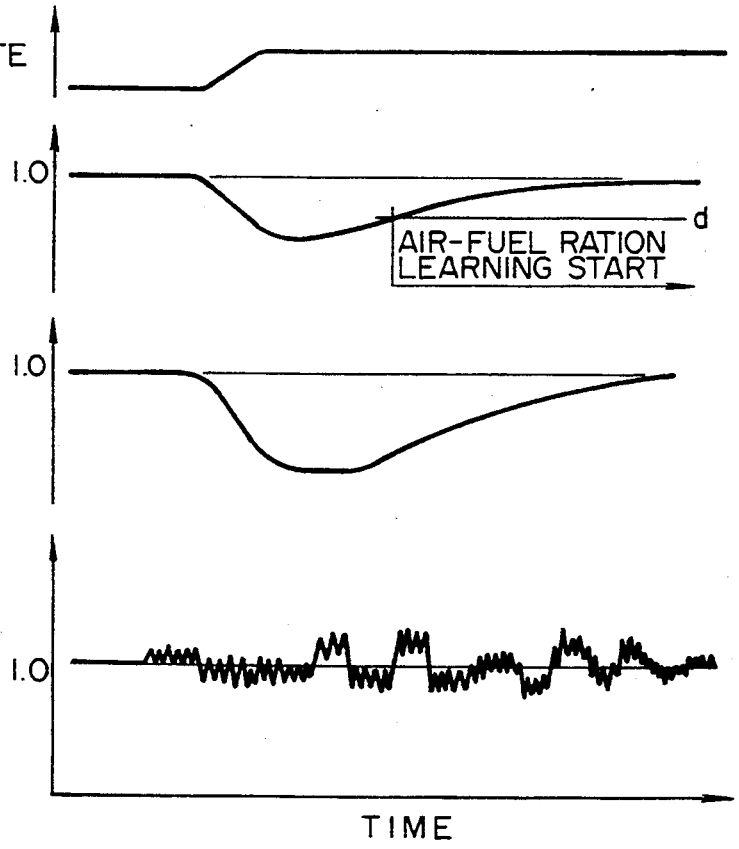

AIR-FUEL RATIO CONTROL APPARATUS FOR INTERNAL COMBUSTION ENGINE

BACKGROUND OF THE INVENTION

The present invention relates to an air-fuel ratio control apparatus for an internal combustion engine constructed for sucking evaporated fuel generated in a fuel tank into the intake system of the internal combustion engine so as to burn the evaporated fuel.

There is a conventional control apparatus (e.g., JP-A-63-129159) adapted for storing in a canister evaporated fuel generated in a fuel tank, discharging or purging from the canister the stored fuel together with air to the intake system of an internal combustion engine so as to be burnt, performing an air-fuel ratio learning operation while the fuel purging operation is stopped in order to avoid influences of the evaporated fuel gas on the learned values of air-fuel ratio.

There is another type conventional control apparatus (e.g., JP-A-2-130240) adapted for updating a learned value of air-fuel ratio by detecting per every engine-operation region a difference between an air-fuel ratio feedback value and a reference value, and subtracting from the detected difference value a value of air-fuel ratio deviation caused due to a quantity of evaporated fuel.

According to the above first type apparatus, it is necessary to frequently stop the fuel purging operation every execution of the air-fuel ratio learning operation, thus it is subjected to a problem of reduction of the fuel purging performance due to a consequent reduction of effective time period of the purging operation.

According to the above second type apparatus, it has a problem that correct air-fuel ratio learning operation can not be done since the variation of an air-fuel ratio feedback value due to influences of evaporated fuel gas becomes larger than the variation of the air-fuel ratio feedback value to be learnt, when the concentration of the evaporated fuel is high.

A preceding U.S. Pat. No. 5,299,546 entitled "Air-fuel ratio control apparatus of internal combustion engine" was filed on Apr. 27, 1993 on the basis of Japanese patent application No. 4-109592 (dated Apr. 28, 1992) and assigned to the present assignee. The U.S. application is concerned with air-fuel ratio control dependent upon fuel purge rate and evaporated fuel gas concentration and inhibition of updating of air-fuel ratio learned values for a predetermined period after start of fuel purging operation.

SUMMARY OF THE INVENTION

It is an object of the present invention to learn an air-fuel ratio preferably without undergoing the reduction of the fuel purge capability and the influence of high concentration evaporated fuel gas.

According to one aspect of the present invention, there is provided an air-fuel ratio control apparatus for an internal combustion engine for storing evaporated fuel generated in a fuel tank in a canister and purging the evaporated fuel stored in the canister to an intake system of the internal combustion engine through a bleedoff passage together with air, the apparatus comprising:

air-fuel ratio detecting means for detecting an air-fuel ratio of the internal combustion engine;

air-fuel ratio feedback means for making feedback control of the air-fuel ratio of the air-fuel mixture supplied to the internal combustion engine in accordance with the air-fuel ratio detected by the air-fuel ratio detecting means;

a flow rate control valve for changing a purge rate of air containing the evaporated fuel drawn off to the intake side of the internal combustion engine from the canister through the bleedoff passage;

purge rate control means for controlling the purge rate by said flow rate control valve in accordance with the state of the engine;

learning value storage means for storing air-fuel ratio learning values;

learning value renewal means for renewing the air-fuel ratio learning values based on the air-fuel ratio feedback value by the air-fuel ratio feedback means;

concentration detecting means for detecting the concentration of the evaporated fuel; and learning inhibiting means for inhibiting renewal of an air-fuel ratio learning value by the air-fuel ratio learning value renewal means when the concentration of the evaporated fuel detected by the concentration detecting means is at a predetermined value or higher.

Accordingly, the present invention has such an excellent effect that it is possible to learn the air-fuel ratio satisfactorily without incurring a lowering of the purge capability and without being affected by the evaporated gas having high concentration.

BRIEF DESCRIPTION OF THE DRAWINGS

FIG. 14 is a flow chart showing a portion different from FIG. 12 in another embodiment of an apparatus of the present invention; and FIGS. 15(*a*) to 15(*d*) are time charts showing waveforms at respective parts in the above-mentioned embodiment.

DESCRIPTION OF THE PREFERRED EMBODIMENTS

Figure 1:
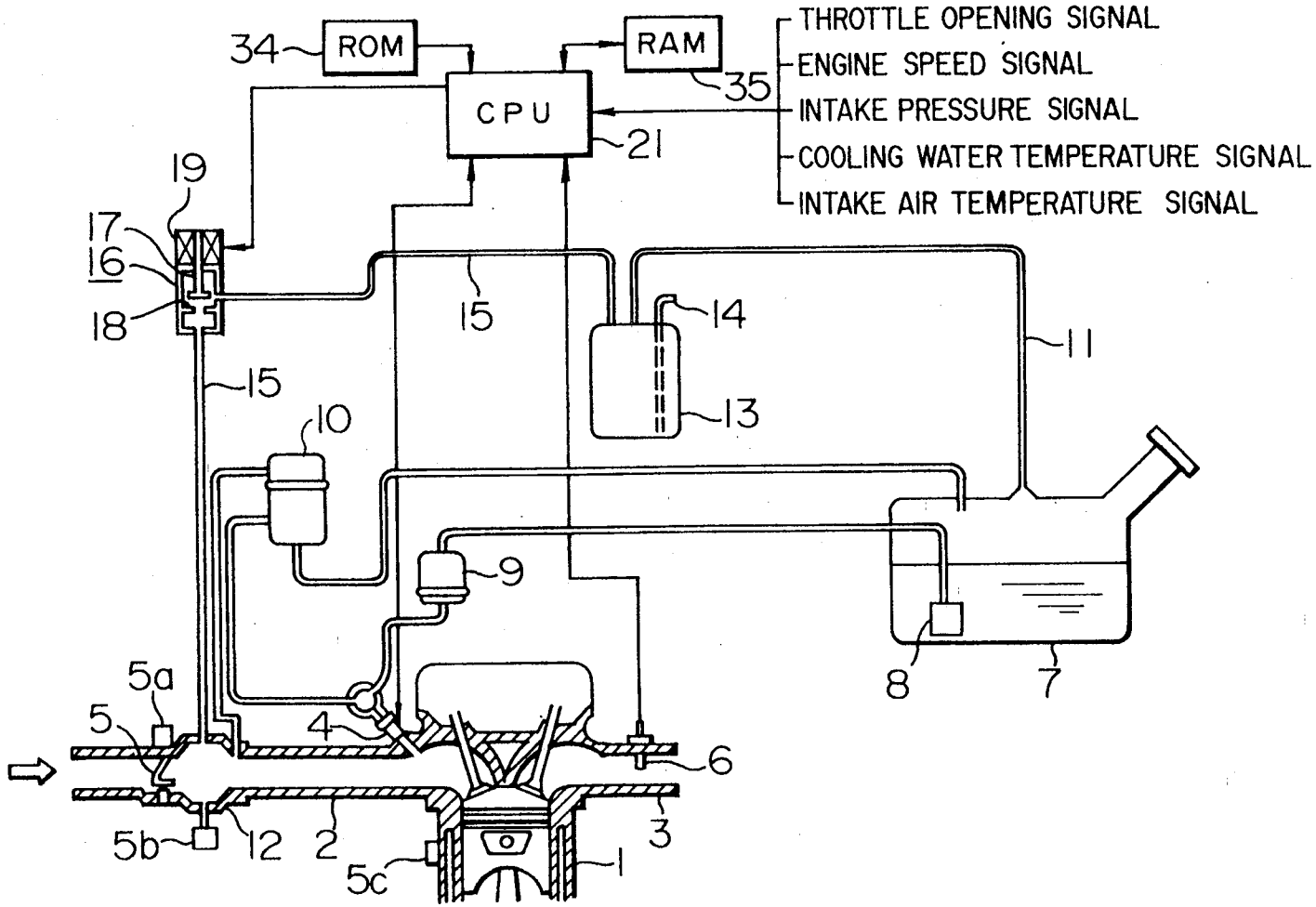
FIG. 1 is a general block diagram showing an embodiment of the present invention.

As shown in FIG. 1, a multi-cylinder engine 1 is mounted on a vehicle, and an intake pipe 2 and an exhaust pipe 3 are connected to the engine 1. An electromagnetic injector 4 is provided at the inner end portion of the intake pipe 2, and a throttle valve 5 is also provided on the upstream side thereof. Furthermore, an oxygen sensor 6 is provided in the exhaust pipe 3 as air-fuel ratio detecting means, and the sensor 6 outputs a voltage signal corresponding to oxygen concentration in the exhaust gas.

A fuel feed system for feeding the fuel to the injector 4 includes a fuel tank 7, a fuel pump 8, a fuel filter 9 and a pressure regulating valve 10. Thus, the fuel (gasoline) in the fuel tank 7 is fed by pressure to the injector 4 of each cylinder through the fuel filter 9 by means of the fuel pump 8, and the fuel fed to each injector 4 is regulated to a predetermined pressure by means of the pressure regulating valve 10.

A purge pipe 11 extending from the top part of the fuel tank 7 is made to communicate with a surge tank 12 of the intake pipe 2, and a canister 13 containing activated charcoal as an adsorbent for adsorbing the evaporated fuel generated in the fuel tank is disposed midway in the purge pipe 11. Further, a hole 14 opening to the atmosphere for introducing fresh air is provided on the canister 13. The purge pipe 11 serves as a bleedoff or discharge passage 15 on the surge tank 12 side of the canister 13, and a variable flow rate electromagnetic valve 16 (hereinafter referred to as a purge solenoid valve) is provided midway in the bleedoff passage 15. In the purge solenoid valve 16, a valve body 17 is always urged toward a direction of closing a seat portion 18 by means of a spring not illustrated, but the valve body 17 opens the seat portion 18 by exciting a coil 19. Thus, the bleedoff passage 15 is closed by demagnetization of the coil 19 of the purge solenoid valve 16, and the bleedoff passage 15 is opened by exciting the coil 19. The opening of the purge solenoid valve 16 is regulated by means of a CPU 21 which is described later by duty ratio control based on pulse width modulation.

Figures 2, 3:
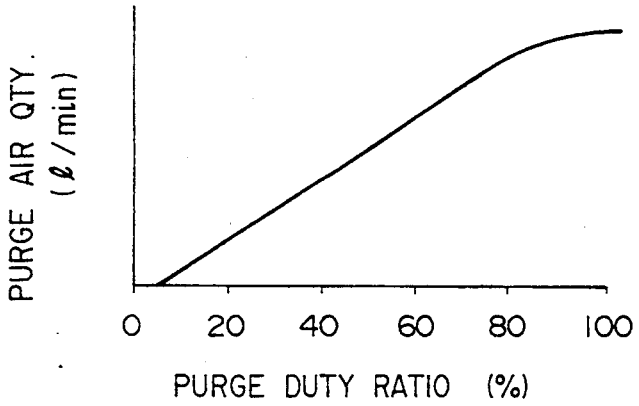
FIG. 2 is a characteristic diagram of a purge solenoid valve in the embodiment.
FIG. 3 is a fully open purge rate map in the embodiment.

Accordingly, when a control signal is applied to the purge solenoid valve 16 from the CPU 21, and the canister 13 is made to communicate with the intake pipe 2 of the engine 1, new air $Q_a$ is introduced from the atmosphere, which ventilates the inside of the canister 13 and is fed into the cylinder through the intake pipe 2 of the engine 1, thus performing canister purge, thereby to recover the adsorbing function of the canister 13. The introduced quantity $Q_p$ (1/min) of the new air $Q_a$ at this time is regulated by changing the duty of a pulse signal applied to the solenoid valve 16 from the CPU 21. FIG. 2 is a characteristic diagram of the purge quantity at this time, and shows the relationship between the duty and the purge quantity of the purge solenoid valve 16 in case a negative pressure in the intake pipe is constant. It is realized from this diagram that, as the purge solenoid is increased from 0%, the purge quantity, i.e., the quantity of air sucked into the engine 1 through the canister 13 increases almost linearly.

The CPU 21 receives a throttle opening signal from a throttle sensor 5*a* for detecting the opening of the throttle valve 5, an engine speed signal from an engine speed sensor not illustrated for detecting the speed of the engine 1, an intake pressure signal from an intake pressure sensor 5*b* (which may be an intake air quantity signal from an intake air quantity sensor) for detecting the pressure of the intake air which has passed through the throttle valve 5, a cooling water temperature signal from a water temperature sensor 5*c* for detecting the temperature of engine cooling water, and an intake temperature signal from an intake temperature sensor not illustrated for detecting the intake air temperature.

Further, the CPU 21 receives a signal (voltage signal) from the oxygen sensor 6, and decides whether the air-fuel mixture is rich or lean. Further, the CPU 21 changes (skips) the feedback correction factor stepwise in order to increase or decrease the fuel injection quantity when rich is inverted to lean or when lean is inverted to rich, and increases or decreases the feedback correction factor gradually in case of rich or lean. Besides, such feedback control is not conducted when the engine cooling water temperature is low and at time of running with a high load and at high engine revolutions. Further, the CPU 21 obtains a basic injection time by the engine speed and the intake pressure, obtains a final injection time TAU by performing correction by a feedback correction factor or the like on the basic injection time, and has fuel injection performed at a predetermined injection timing by the injector 4.

A ROM 34 stores programs and maps for controlling the operation of the whole engine. A RAM 35 temporarily stores various data such as detected data of the opening of the throttle valve 5, an engine speed or the like. Then, the CPU 21 controls the operation of the engine based on the programs in the ROM 34.

FIG. 3 shows a full admission purge rate map in percentage (%), which is determined by an engine speed Ne and a load (which is an intake pipe pressure in this case, and may be an intake air quantity or a throttle opening instead). This map shows a ratio of the air quantity flowing through the bleedoff passage 15 at 100% duty of the purge solenoid valve 16 to the total air quantity flowing into the engine 1 through the intake pipe 2, and is stored in the ROM 34.

The present system is operated through air-fuel ratio feedback (FAF) control, purge rate control, evaporated fuel concentration detection, fuel injection quantity control, air-fuel ratio learning control and purge solenoid valve control.

The operation of the embodiment will be described hereinafter with respect to every control.

Air-fuel Ratio Feedback Control

The air-fuel ratio feedback control will be described with reference to FIG. 4. This air-fuel ratio feedback control is executed in accordance with a base routine of the CPU 21 at intervals of 4 ms.

First, it is determined whether the feedback (F/B) control is possible or not in a step S40. The F/B conditions in this case satisfy all of the conditions shown hereunder principally.

That is, (1) not the time of starting, (2) not during fuel cut-off, (3) cooling water temperature (THW) $\geqq 40°$ C., (4) $TAU > TAU_{min}$, and (5) an oxygen sensor being in an activated state.

If these conditions are satisfied, the process proceeds to a step S42, where an oxygen sensor output and a predetermined decision level are compared with each other, and an air-fuel ratio flag XOXR is manipulated with a delay time (H and I msec), respectively. For example, it is assumed to be rich when XOXR=1, and to be lean when XOXR=0. Next, the process proceeds to a step S43, where the value of FAF is manipulated based on XOXR described above. Namely, when XOXR changes from 0 to 1 or from 1 to 0, the value of FAF is made to skip by a predetermined quantity, and while XOXR continues to be 1 or 0, integral control of the FAF value is performed.

Then, after the process proceeds to a step S44 and upper and lower limits of the FAF value are checked, the process proceeds to a step S45, where small smoothing (instantaneous averaging) processing is performed from skip to skip or at intervals of predetermined time (i.e., a value obtained by adding a preceding value and a value this time of the FAF value immediately before skip to each other is divided by 2), thereby to obtain a small smoothed value (instantaneously averaged value) FAFAV. In case F/B control is not effected in the step S40, the process proceeds to a step S46, where the FAF value is set to 0.1.

Purge Rate Control

Figure 5:
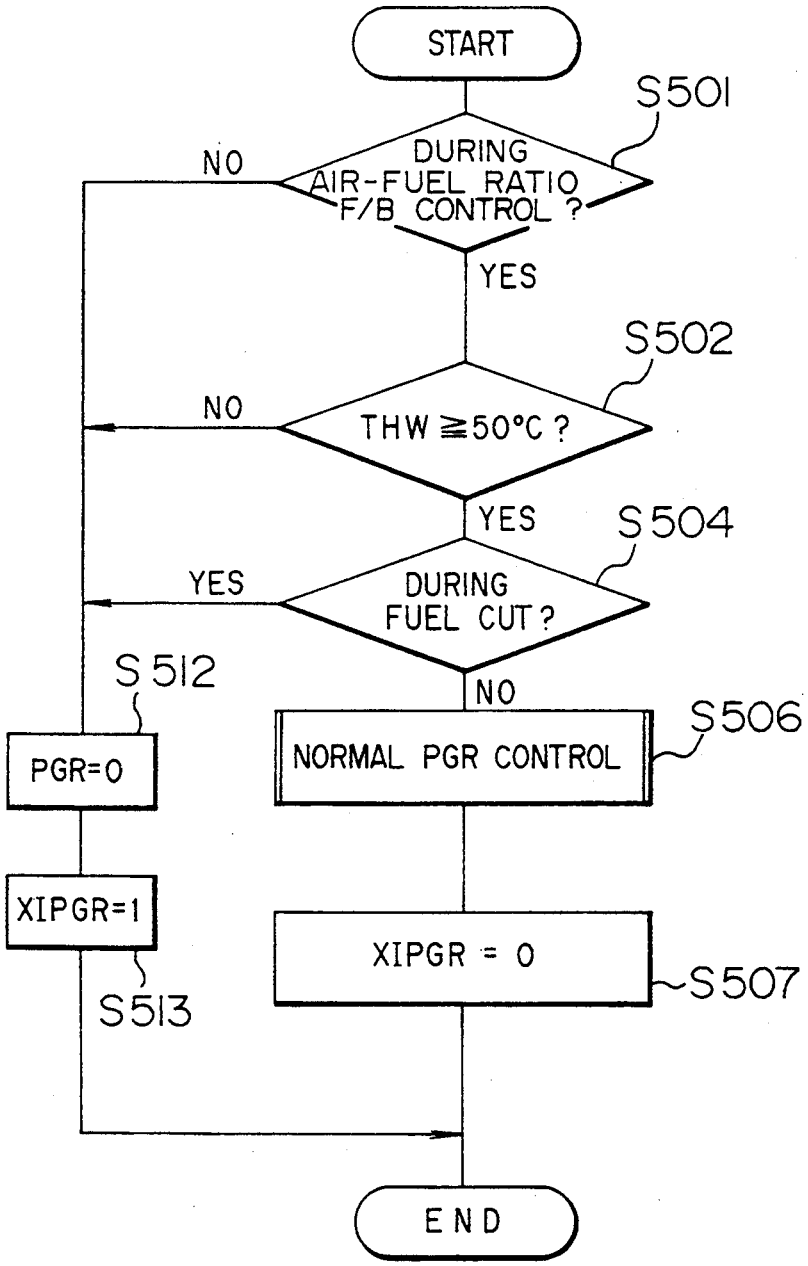
FIG. 5 is a flow chart showing purge rate control in the embodiment.

A main routine of purge rate control is shown in FIG. 5. This routine is also executed approximately every 4 ms in accordance with the base routine of the CPU 21.

Figure 4:
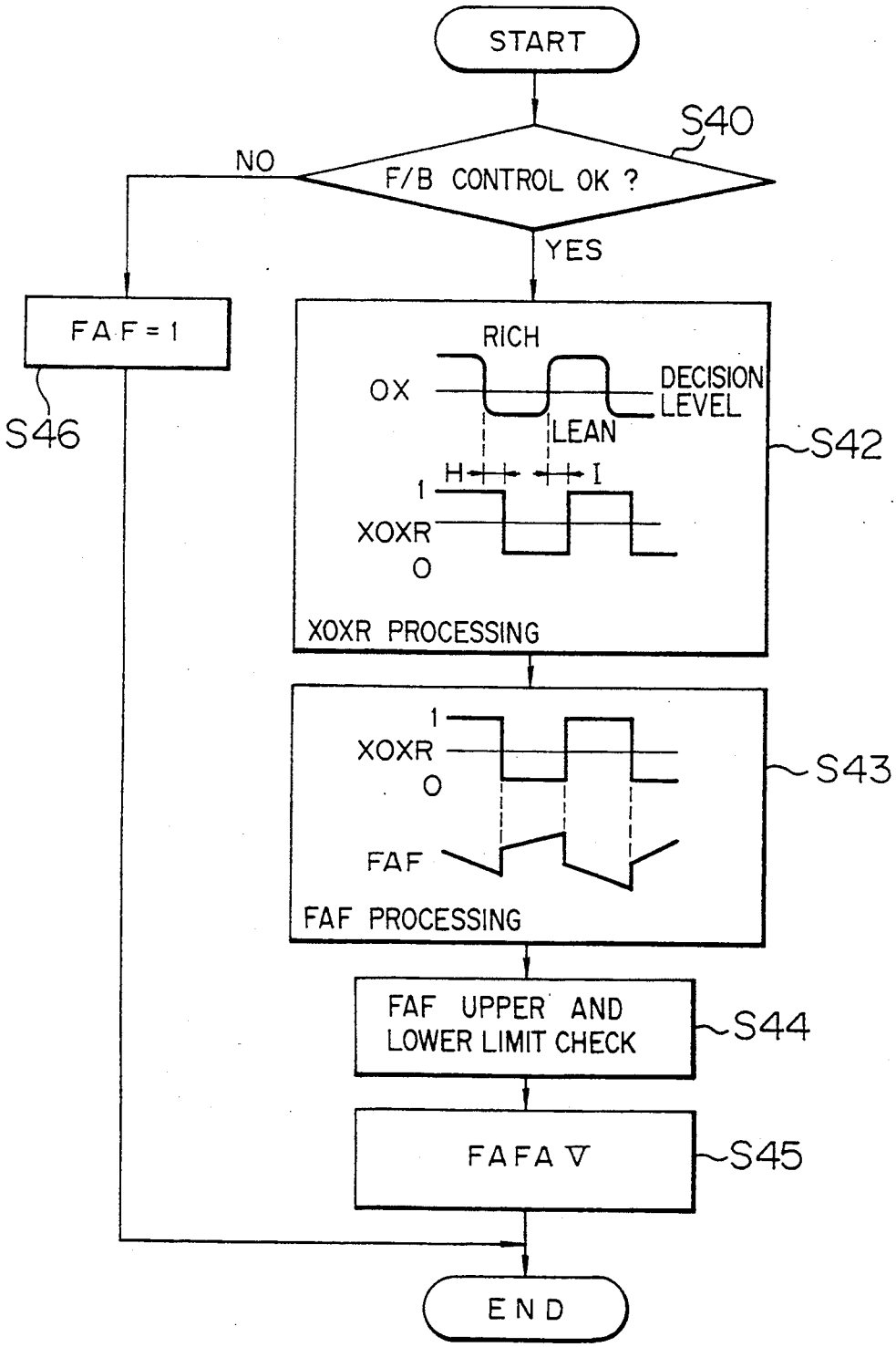
FIG. 4 is a flow chart showing air-fuel ratio feedback control in the embodiment.

It is determined in a step S501 whether during air-fuel ratio F/B control or not under similar conditions to those in the step S40 shown in FIG. 4, and it is also determined in a step S502 whether the cooling water temperature is 50° C. or higher. In case the air-fuel ratio is under F/B control and the water temperature is at a predetermined value of 50° C. or higher, it is determined in a following step S504 whether in a fuel cut state or not. When it is determined to be not in a fuel cut state, the process proceeds to a step S506, where ordinary purge rate control is performed, and thereafter, a purge unexecuted flag XIPGR is set to 0 in a step S507 in order to execute purge rate control. Besides, when,- the purge conditions have not been satisfied in the steps S501, S502 and S504, the process proceeds to a step S512, where the purge rate is set to 0, and thereafter, the process proceeds to a step S513, where the purge unexecuted flag XIPGR is set to 1.

Figure 6:
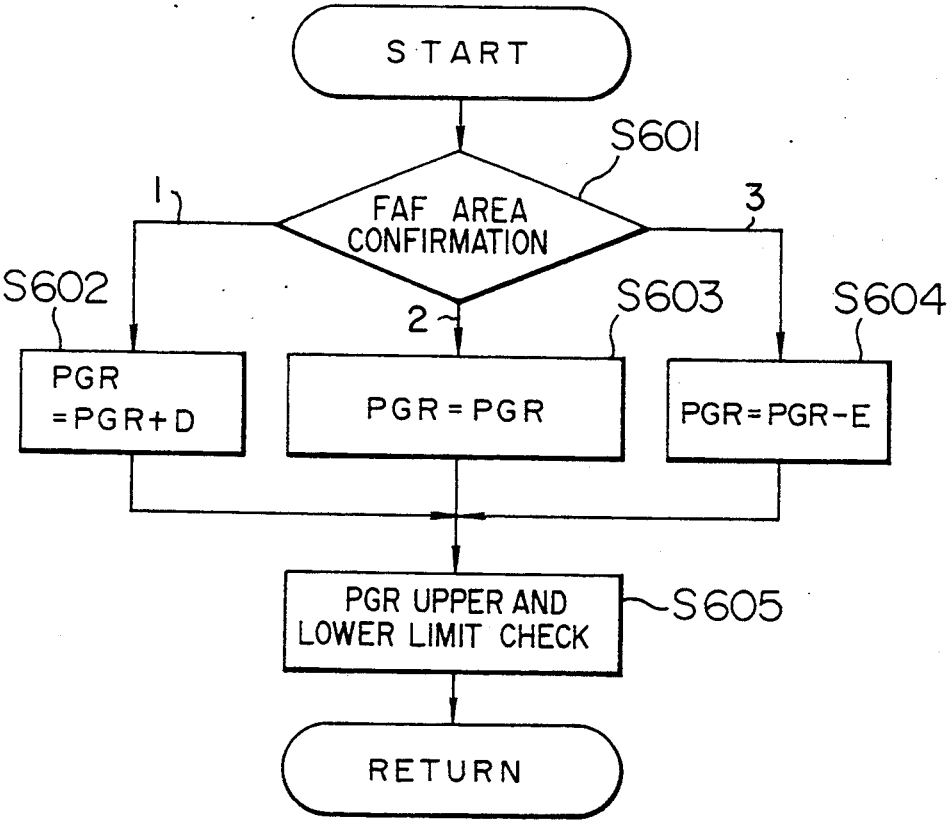
FIG. 6 is a flow chart showing an ordinary purge rate control subroutine in the embodiment.
Figure 7A:
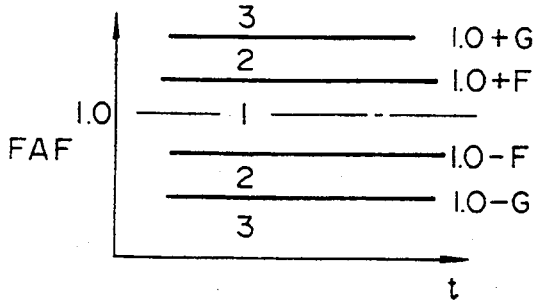
FIGS. 7A to 7E are various characteristic diagrams normally used for purge rate control subroutines in the embodiment.

An ordinary purge rate control subroutine in the step S506 shown in FIG. 5 is shown in FIG. 6. First, in a step S601, it is detected in which area among three areas (1, 2, 3) the FAF value (or a FAFAV value) is located with respect to the reference value 1.0. Here, as shown in FIG. 7A, the area 1 shows the FAF value is within 1.0±F%, the area 2 shows the value is apart at 1.0±F % or more and within ±G % (where, F<G), and the area 3 shows the FAF value is located at 1.0±G % or more.

Figure 7C:
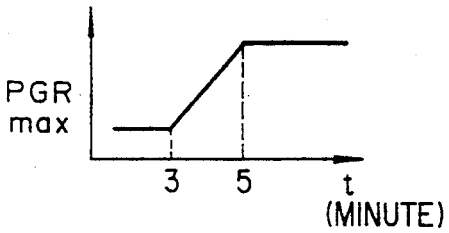
Figure 7B:
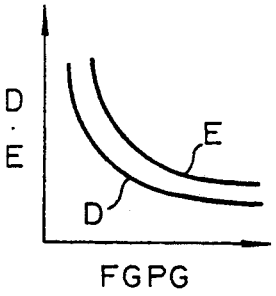
Figure 7D:
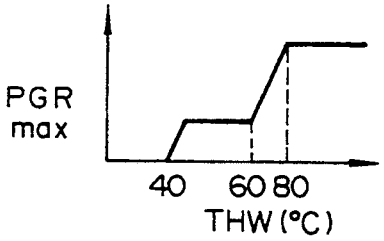
Figure 7E:
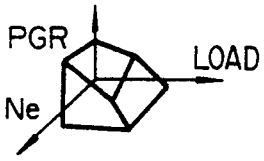

In the case of the area 1, the process proceeds to a step S602, and the purge rate (PGR) is increased by a predetermined value D% at a time. In the case of the area 2, the process proceeds to a step S603, and nothing is changed in PGR. In the case of the area 3, the process proceeds to a step S604, and PGR is reduced by a predetermined value E % at a time. Here, it is desirable to change the predetermined values D and E in accordance with the evaporative concentration (FGPG) as shown in FIG. 7B. Then, upper and lower limits of PGR are checked in a next step S605. Here, the upper limit value shall be of the smallest value among various conditions such as the purge variation on purge starting time shown in FIG. 7C, purge variation by water temperature shown in FIG. 7D and operating conditions (full admission purge rate map) shown in FIG. 7E.

Evaporative Concentration Detection

Figure 8:
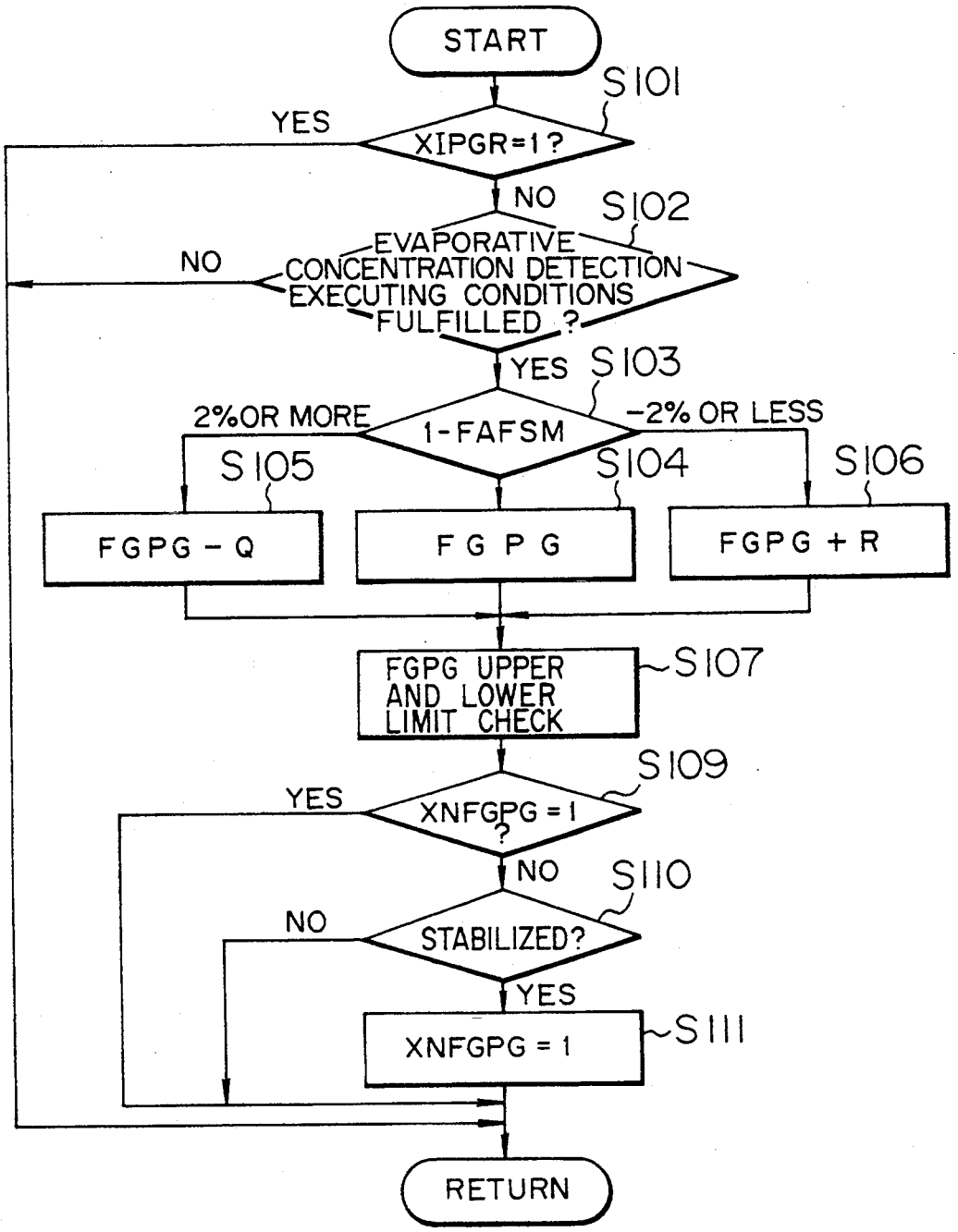
FIG. 8 is a flow chart showing evaporative concentration detection in the embodiment.

A main routine of evaporative concentration detection executed approximately every 4 ms in the base routine of the CPU 21 is shown in FIG. 8. First, when the purge control is executed and the purge unexecuted flag XIPGR is not 1 in a step S101, the process proceeds to a step S102. When the flag XIPGR is 1 and purge control has not been executed, the process is terminated as it is. Further, it is determined in the step S102 whether evaporative concentration detection executing conditions are met or not. Here, determination on fulfillment of evaporative concentration detection executing conditions is made when all of the basic conditions that the air-fuel ratio is under feedback control, the cooling water temperature THW is 80° C. or higher, increase in quantity after starting is 0, and increase in warming-up quantity is 0 are satisfied. Further, when it is determined in the step S102 that the evaporative concentration detection executing conditions are not met, the process is terminated as it is, and when it is determined that the evaporation detection executing conditions are met, the process proceeds to a step S103, and evaporative concentration renewal is executed.

In this step S103, it is determined whether a deviation of a large smoothing value FAFSM of FAF obtained in a routine shown in FIG. 12 described later from the reference value 1 is at a predetermined value (2% for instance) or more. When negative, the process proceeds to a step S104, where the value of the evaporative concentration FGPG is set at a value same as the preceding value without renewing the value of FGPG, and when affirmative, the process proceeds to a step S105 or S106, where the evaporative concentration is renewed. The renewal method is performed by increasing or decreasing the evaporative concentration FGPG by predetermined values Q and R (both 0.4% for instance), respectively, when the difference between the large smoothing value FAFSM of FAF and the reference value 1.0 of FAF is larger than a predetermined value (2% for instance). Next, the process proceeds to a step S107 and upper and lower limits of the evaporative concentration FGPG are checked. Here, the upper limit value of FGPG is set to 1.0 and the lower limit thereof is set to 0.7 for instance.

The value of the evaporative concentration FGPG in the present embodiment becomes 1 when the evaporative concentration in the bleedoff passage 15 is 0 (air is 100%), and is set to a value smaller than 1 as the evaporative concentration in the bleedoff passage 15 gets higher. Here, it may also be arranged so as to obtain the evaporative concentration by replacing FAFSM with 1 in the step S103 shown in FIG. 8 or by replacing the step S105 with the step S106 so that the value of FGPG is set to a value larger than 1 as the evaporative concentration gets higher.

Then, it is determined in a following step S109 whether the initial concentration detection end flag XNFGPG is 1, and the process proceeds to a following step S110 when it is not 1, and is terminated as it is when it is 1. In the step S110, it is determined whether the variation between preceding detected value to the detected value this time of the evaporative concentration FGPG continues three times or more at a predetermined value (0%) or below and the evaporative concentration has been stabilized. When the evaporative concentration is stabilized, the process proceeds to a following step S111 and is terminated after setting the initial concentration detection end flag XNFGPG to 1. Further, when it is determined in the step S110 that the evaporative concentration has not been stabilized, the process is terminated as it is. Here, it is a matter of course that the initial concentration detection end flag XNFGPG is initially set to 0 at the time of switching a key switch on.

Fuel Injection Quantity Control

Figure 9:
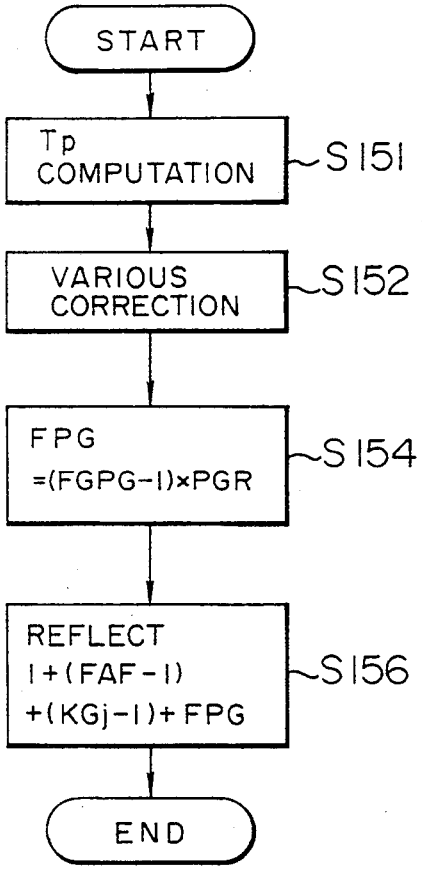
FIG. 9 is a flow chart showing fuel injection control in the embodiment.

Fuel injection quantity control executed approximately every 4 ms in the base routine of the CPU 21 is shown in FIG. 9.

First, a basic fuel injection quantity (TP) is obtained by engine speed and load (such as pressure in the intake pipe) based on the data stored in the ROM 34 as a map in a step S151, and various basic corrections (such as cooling water temperature, after starting and intake air temperature) are made in a following step S152. Next, in a step S154, a purge correction factor FPG is obtained by multiplying a value obtained by subtracting 1 from the evaporative concentration FGPG by the purge rate PGR. Thereafter, in a following step S156, FAF, FPG and air-fuel ratio learning values ($KG_j$) in each engine operating area are obtained as correction factors through the computation of:

$$1+(FAF-1)+(KG_j-1)+FPG$$

thereby to reflect them to the fuel injection quantity TAU.

Purge Solenoid Valve Control

Figure 10:
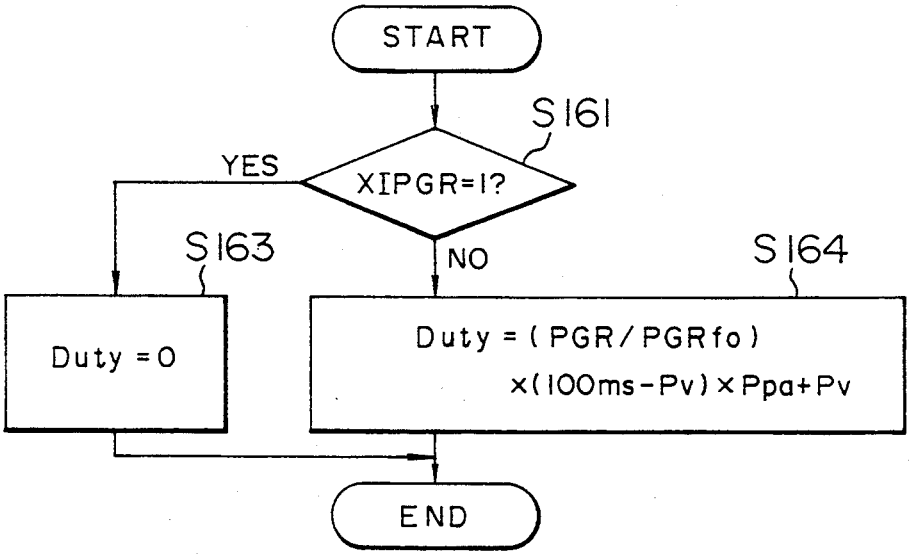
FIG. 10 is a flow chart showing purge solenoid valve control in the embodiment.

A purge solenoid valve control routine executed by time interruption at intervals of 100 ms by the CPU 21 is shown in FIG. 10. When the purge unexecuted flag XIPGR is 1 in a step S161, the process proceeds to a step S163 and Duty of the purge solenoid valve 16 is set to 0. Otherwise, the process proceeds to a step S164, and Duty of the purge solenoid valve 16 is obtained by an operation expression:

$$\text{Duty}=(PGR/PGR_{f0})\times(100\ ms-P_V)\times P_{pa}+P_V$$

assuming that the drive period of the purge solenoid valve 16 is 100 ms. Where, PGR represents the purge rate obtained in FIG. 6, $PGR_{f0}$ represents a purge rate in each operating state when the purge solenoid valve 16 is fully opened (see FIG. 3), $P_V$ represents a voltage correction value on the fluctuation of battery voltage, and $P_{pa}$ represents an atmospheric pressure correction value on the fluctuation of the atmospheric pressure.

Air-fuel Ratio Learning Control

Figure 11:
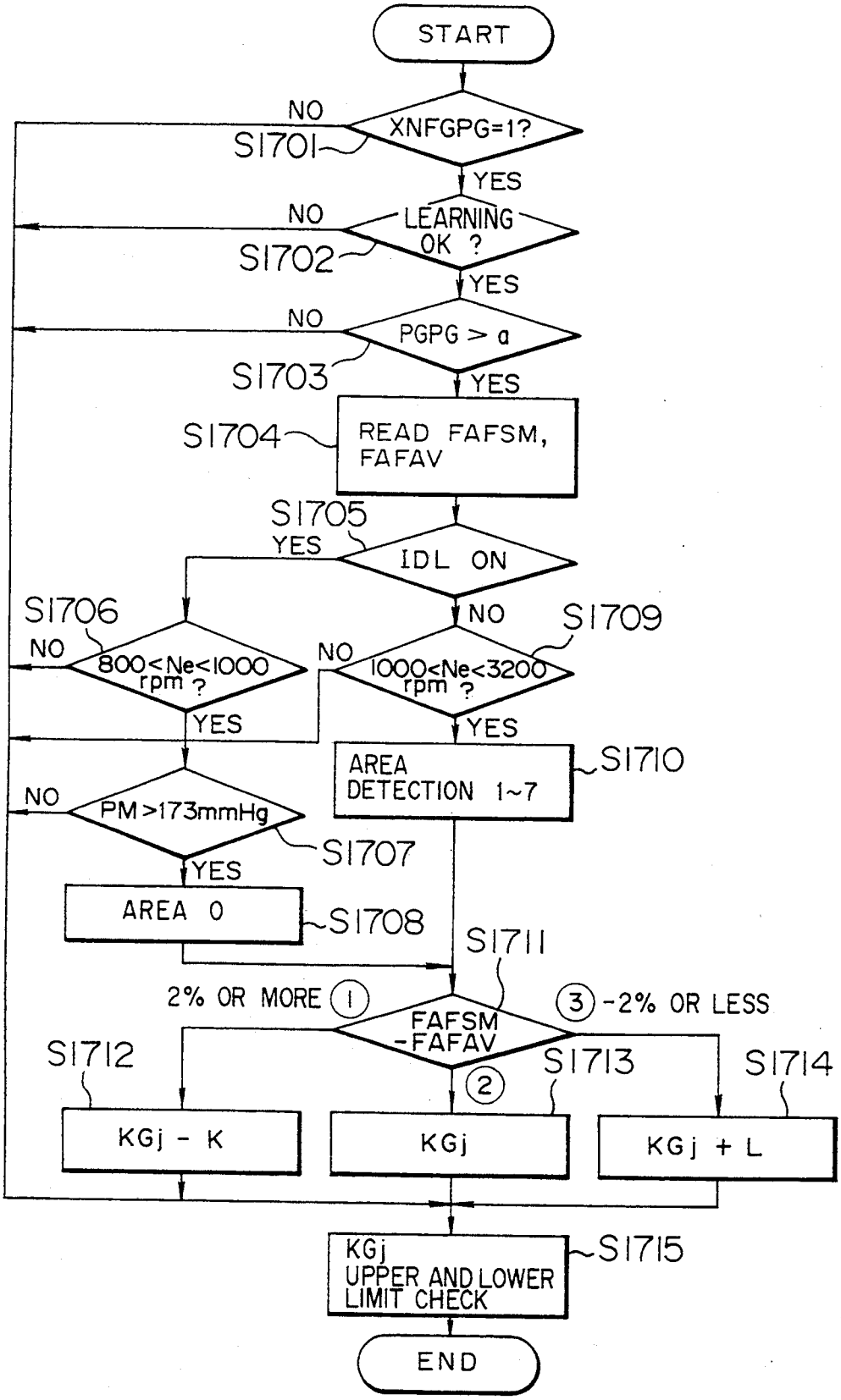
FIG. 11 is a flow chart showing air-fuel ratio learning control in the embodiment.

Next, an air-fuel ratio learning control routine executed whenever the FAF value skips is shown in FIG. 11. First, it is determined in a step S1701 whether the initial concentration detection end flag XNFGPG is 1 or not, and the process is terminated as it is when the flag is not 1, and the process proceeds to a following step S1702 when it is 1, where it is determined that all the basic conditions, i.e., during air-fuel ratio feedback, the cooling water temperature THW is 80° C. or higher, increase in quantity after starting is 0, increase of warming-up quantity is 0, the FAF value has skipped five times or more since entering into the present operating area and battery voltage is 11.5 V or higher are satisfied. The process is terminated as it is in case even any one of the basic conditions is not satisfied, and the process proceeds to a following step S1703 when all the basic conditions are satisfied.

In the step S1703, it is determined whether the detected evaporation FGPG value is at a predetermined value $\alpha$ (0.95 for instance) or above, and the process is terminated as it is when the detected evaporative concentration FGPG value is below the predetermined value $\alpha$ and the evaporative concentration is high, and air-fuel ratio learning control by area is made when the detected evaporative concentration FGPG value is above the predetermined value $\alpha$ and the evaporative concentration is low.

The learning control is made at idling time $KG_0$ (step S1708) and travelling time (step S1710) separately depending on the result of determination whether idling or not in a step S1705 after reading the values of FAFAV and FAFSM in a step S1704, and is made in a plurality of numbers (seven for instance) of areas $KG_1$ to $KG_7$ depending on the load (pressure in the intake pipe for instance) at running time. Further, the learning value is renewed in steps S1706 and S1709 only when the engine speed is within a predetermined engine speed (600 to 1,000 rpm at idling time, and 1,000 to 3,200 rpm at running time).

Furthermore, the learning values are renewed at idling time when it is determined in a step S1707 that an intake pipe pressure PM is 173 mmHg or higher. The renewal method of learning values $KG_0$ to $KG_7$ in respective areas is performed in such a manner that, when the difference between the large smoothing value FAFSM of FAF and the small smoothing value FAFAV of FAF is larger than a predetermined value (0.2% for instance), the learning values $KG_0$ to $KG_7$ in the areas are increased or decreased by predetermined values K and L (both 2% for instance) (steps S1711 to S1714). Finally, upper and lower limits of $KG_j$ are checked (step S1715).

Here, for example, the upper limit value of $KG_j$ is set to 1.2 and the lower limit value thereof is set to 0.8, and it is also possible to set these upper and lower limit values for every engine operating area. Besides, it is a matter of course that the learning values $KG_0$ to $KG_7$ in respective areas are stored in a RAM backed up by a power source so as to hold stored values even after the key switch is disconnected.

Operation of Air-fuel Ratio Correction Factor Large Smoothing Value

Figure 12:
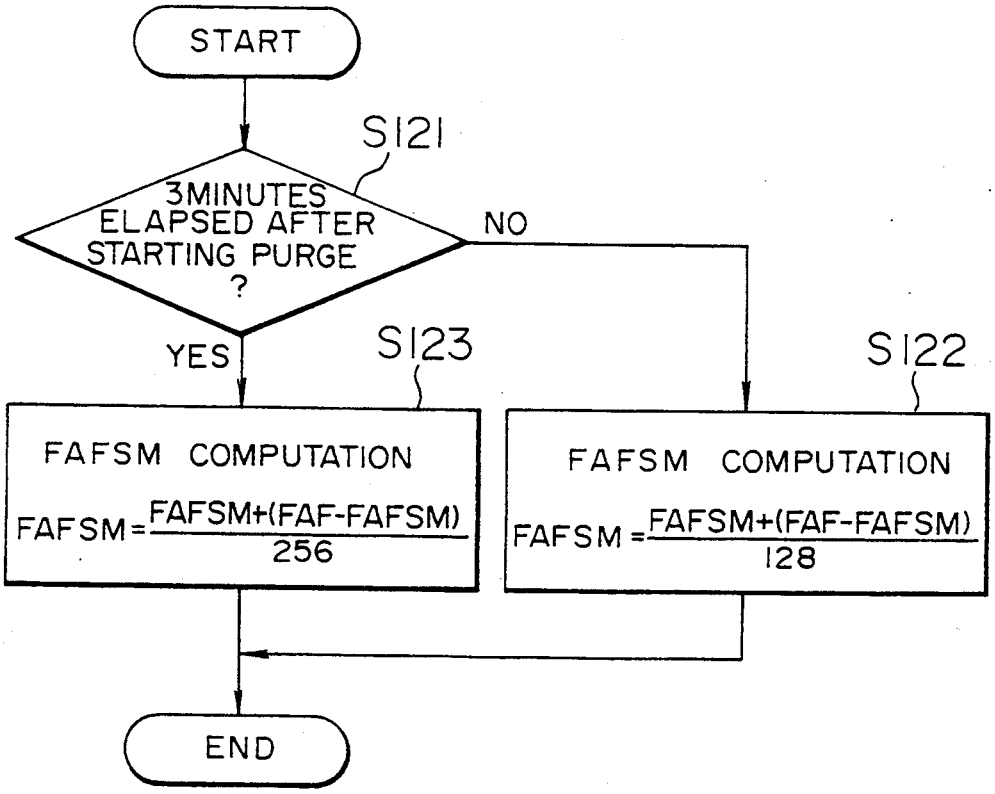
FIG. 12 is a flow chart showing air-fuel ratio feedback value large smoothing computation in the embodiment.

An operation routine of an air-fuel ratio correction factor large smoothing value FAFSM executed by time interruption at intervals of 100 ms by the CPU 21 is shown in FIG. 12.

First, it is determined in a step S121 whether a predetermined time, e.g., 3 minutes or longer, has elapsed since the first purge is started after the key switch is put on, and the process proceeds to a step S122 and FAFSM is computed by one-128th smoothing as a first smoothing constant because the variation speed of the evaporative concentration is comparatively high immediately after starting purge when 3 minutes or longer have not elapsed as yet. Further, in case 3 minutes or longer have elapsed, the process proceeds to a step S123 and FAFSM is computed by one-256th smoothing as a second smoothing constant larger than that in the step S122 because purging has advanced and the variation speed of the evaporative concentration is comparatively slow.

Although the smoothing constant of FAFSM is thus exchanged in accordance with the time elapsed from the start of purging, the deviation from the reference value 1.0 of FAFSM becomes to correspond to the evaporative concentration since the smoothing constant of FAFSM has a sufficiently larger smoothing constant than FAFAV in the step S45 in FIG. 4, and it becomes possible to learn an air-fuel ratio removed of slippage due to the influence by the evaporative concentration by using the deviation between FAFSM and FAFAV in air-fuel ratio learning control shown in FIG. 11.

Figures 13B, 13D, 13E:
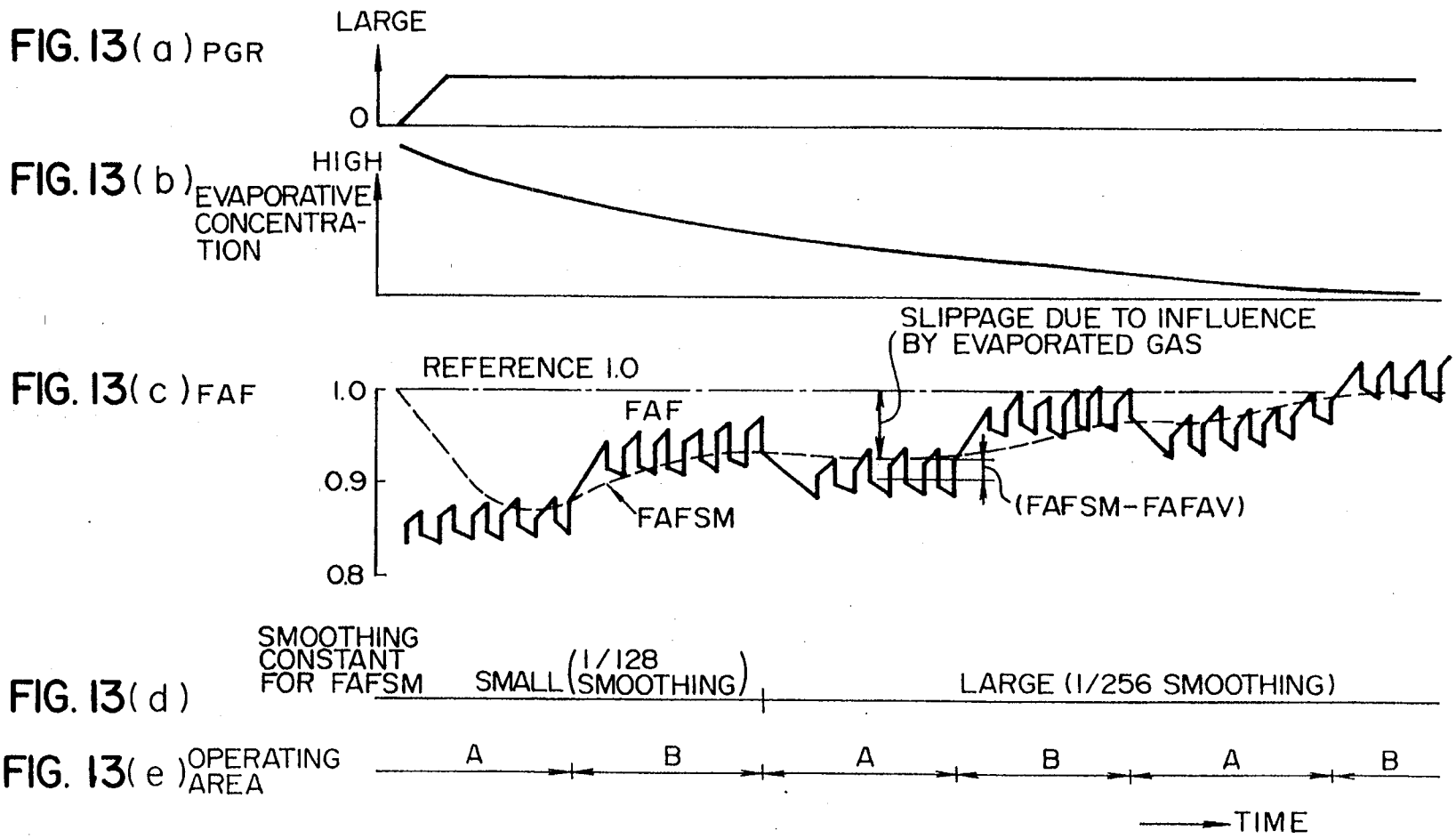
FIGS. 13(*a*) to 13(*e*) show waveforms at respective parts in the embodiment.

A time chart of the above-described embodiment is shown in FIGS. 13(*a*) to 13(*e*), wherein FIG. 13(*a*) shows the purge rate PGR, FIG. 13(*b*) shows a practical variation state of the evaporative concentration since purging is started, FIG. 13(*c*) shows the FAF values (solid line) and FAFSM values (broken line), FIG. 13(*d*) shows a state of selecting a smoothing constant for FAFSM, and FIG. 13(*e*) shows the variation state of the engine operation area with two areas A and B. In FIG. 13(*c*), the behaviors of the FAF value (solid line) and the FAFSM value (broken line) in a state that a fuel loss correction factor FPG is not reflected upon the fuel injection quantity are shown in order to clarify the fact that the FAFSM value corresponds to the slippage due to the influence by the evaporative gas. Practically, however, the FAF value and the FAFSM value show behaviors of rising and falling in the vicinity of the reference value 1.0 by reflecting the fuel loss correction factor FPG upon the fuel injection quantity.

A time chart in case the fuel loss correction factor FPG is made to reflect as described above is shown in FIGS. 15(*a*) to 15(*d*), wherein FIG. 15(*a*) shows the purge rate PGR, FIG. 15(*b*) shows the evaporative concentration FGPG value, FIG. 15(*c*) shows the fuel loss correction factor FPG, and FIG. 15(*d*) shows the FAF value. As shown in FIG. 15(*b*), the air-fuel ratio learning value is renewed only when the evaporative concentration FGPG value reaches $\alpha$ or higher and the evaporative concentration is low at a predetermined value or below.

Besides, the smoothing constant of FAFSM has been selected depending on whether a predetermined time has elapsed after purging is started or not as shown in FIG. 12 in the above-mentioned embodiment, but it may also be arranged so as to select the smoothing constant of FAFSM in accordance with the detected evaporative concentration FGPG value. A portion used in place of the step S121 in FIG. 12 is shown in FIG. 14 as an embodiment in this case.

Namely, it is determined in a step S131 whether the initial evaporative concentration has been terminated depending on whether the flag XNFGPG is 1 or not, and the process proceeds to a step S122 when the initial evaporative concentration renewal has not been terminated and the process proceeds to a step S132 when the initial evaporative concentration renewal has been terminated. In the step S132, it is determined whether the detected evaporative concentration FGPG value is at a predetermined value $\beta$ (0.95 for instance) or above, and the process proceeds to the step S122 when the detected evaporative concentration FGPG value is below the predetermined value $\beta$ and the evaporative concentration is high and the process proceeds to the step S123 when the detected evaporative concentration FGPG value is at a predetermined value $\beta$ or above and the evaporative concentration is low.

Further, the evaporative concentration FGPG value is obtained by the deviation from the reference value of FAFSM at time of ordinary purge rate control execution in the above-mentioned embodiment. However, as described in JP-A-2-130240, it may also be arranged so that the purge rate is changed forcibly and the evaporative concentration value is obtained from the quantity of changing the purge rate and the variation of the air-fuel ratio feedback value at that time.

As described above, according to the present invention, renewal of the air-fuel ratio learning value by air-fuel ratio learning value renewal means is inhibited when the concentration of evaporated fuel is at a predetermined value or higher and the air-fuel ratio learning value is renewed even during purging when the concentration of the evaporated fuel is lower than the predetermined value. Accordingly, the present invention has such an excellent effect that it is possible to learn the air-fuel ratio satisfactorily without incurring lowering of purge capability and without being affected by the evaporated gas having high concentration.

We claim:

1. An air-fuel ratio control apparatus of an internal combustion engine for storing evaporated fuel generated in a fuel tank in a canister and drawing off the evaporated fuel stored in the canister to an intake side of the internal combustion engine through a bleed-off passage together with air, comprising:

air-fuel ratio detecting means for detecting an air-fuel ratio of said internal combustion engine;

air-fuel ratio feedback means for making feedback control of the air-fuel ratio of the air-fuel mixture supplied to the internal combustion engine in accordance with the air-fuel ratio detected by the air-fuel ratio detecting means;

a flow rate control valve for changing a purge rate of air containing the evaporated fuel [blown]drawn off to the intake side of said internal combustion engine from said canister through said bleedoff passage;

purge rate control means for controlling the purge rate by said flow rate control valve in accordance with the state of the engine;

learning value storage means for storing air-fuel ratio learning values;

learning value renewal means for renewing said air-fuel ratio learning values based on the air-fuel ratio feedback value by said air-fuel ratio feedback means;

concentration detecting means for detecting the concentration of said evaporated fuel; and learning inhibiting means for inhibiting renewal of an air-fuel ratio learning value by said air-fuel ratio learning value renewal means when the concentration of said evaporated fuel detected by the concentration detecting means is at a predetermined value or higher.

2. An apparatus according to claim 1, wherein said concentration detecting means detects the concentration of said evaporated fuel based on an air-fuel ratio feedback value by said air-fuel ratio feedback means.

3. An apparatus according to claim 1, further comprising large smoothing means for smoothing said air-fuel ratio feedback values with comparatively large smoothing constants, wherein said air-fuel ratio learning value renewal means renews said air-fuel ratio learning value based on the deviation between the smoothing output value of said large smoothing means and said air-fuel ratio feedback value.

4. An apparatus according to claim 2, further comprising large smoothing means for smoothing said air-fuel ratio feedback value with a comparatively large smoothing constant, wherein said air-fuel ratio learning value renewal means renews said air-fuel ratio learning value based on the deviation between the smoothing output value of said large smoothing means and said air-fuel ratio feedback value.

5. An apparatus according to claim 4, wherein said concentration detecting means detects the concentration of said evaporated fuel by the deviation from the reference value of the smoothing output of said large smoothing means.

6. An apparatus according to claim 3, further comprising smoothing constant selecting means for selecting a smoothing constant of said large smoothing means in accordance with a state of an engine.

7. An apparatus according to claim 6, wherein said smoothing constant selecting means selects a first smoothing constant until a predetermined time elapses after purging is started by said flow rate control valve, and selects a second smoothing constant having a larger value than said first smoothing constant after a predetermined time has elapsed.

8. An apparatus according to claim 6, wherein said smoothing constant selecting means selects a first smoothing constant when the fuel concentration detected by said concentration detecting means is higher than a predetermined value, and selects a second smoothing constant having a value larger than said first smoothing constant when the fuel concentration is low.

9. An apparatus according to claim 8, wherein said concentration detecting means detects the concentration of said evaporated fuel by the deviation from the reference value of the smoothing output of said large smoothing means.

* * * * *

UNITED STATES PATENT AND TRADEMARK OFFICE

CERTIFICATE OF CORRECTION

PATENT NO. : 5,406,927
DATED : April 18, 1995
INVENTOR(S) : Kato, et al

It is certified that error appears in the above-indentified patent and that said Letters Patent is hereby corrected as shown below:

On the title page: Item [73] should read "Toyoda Jidosha Kabushiki Kaisha" to --Toyota Jidosha Kabushiki Kaisha-- on the cover page of the Patent.

Signed and Sealed this

Nineteenth Day of December, 1995

Bruce Lehman

*Attest:*

BRUCE LEHMAN

*Attesting Officer*

*Commissioner of Patents and Trademarks*